US006767293B2

(12) United States Patent
Pechter et al.

(10) Patent No.: US 6,767,293 B2
(45) Date of Patent: Jul. 27, 2004

(54) GOLF CLUB PUTTER AND METHOD OF PUTTING

(76) Inventors: Martin Pechter, 751 Park of Commerce Dr., Boca Raton, FL (US) 33487; Ronald I. Kall, 8751 W. Broward Blvd., Plantation, FL (US) 33324

( * ) Notice: Subject to any disclaimer, the term of this patent is extended or adjusted under 35 U.S.C. 154(b) by 7 days.

(21) Appl. No.: 10/076,073

(22) Filed: Feb. 15, 2002

(65) Prior Publication Data

US 2003/0157993 A1 Aug. 21, 2003

(51) Int. Cl.[7] ..... A63B 53/02; A63B 53/04
(52) U.S. Cl. ..... 473/313; 473/330
(58) Field of Search ..... 473/313, 314, 473/330, 331, 340, 341, 316, 305, 251, 324, 409, 219, 238, 257, 262, 263, 293, 294

(56) References Cited

U.S. PATENT DOCUMENTS

| | | | | | |
|---|---|---|---|---|---|
| 1,631,504 | A | | 6/1927 | Redman | |
| 3,430,963 | A | | 3/1969 | Wozniak et al. | |
| 3,459,426 | A | * | 8/1969 | Sherwood | 473/201 |
| 3,989,257 | A | | 11/1976 | Barr | |
| 4,121,833 | A | * | 10/1978 | Prueter | 473/330 |
| 4,508,342 | A | | 4/1985 | Drake | |
| 4,756,535 | A | | 7/1988 | Bradley | |
| 4,815,739 | A | * | 3/1989 | Donica | 473/313 |
| 5,160,141 | A | * | 11/1992 | Crews | 473/313 |
| 5,447,310 | A | | 9/1995 | Jernigan | |
| D364,907 | S | * | 12/1995 | Estridge et al. | D21/739 |
| D382,613 | S | * | 8/1997 | Devendorf | D21/739 |
| 6,152,832 | A | | 11/2000 | Chandler, III | |
| 6,267,689 | B1 | * | 7/2001 | Ambrose | 473/251 |

OTHER PUBLICATIONS

International Search Report (Dated May 21, 2003).

* cited by examiner

*Primary Examiner*—Sebastiano Passaniti
(74) *Attorney, Agent, or Firm*—Nixon Peabody LLP; Donald R. Studebaker

(57) ABSTRACT

A golf club putter and method of putting which complies with the rules of golf provides the player with an improved view of the ball and head of the putter when putting putts of a short distance. The method provides a putting stroke which aids the golfer in carrying out a putting stroke, maintains the putting face of the putter in a perpendicular orientation which respect to the line-of-putt thereby compensating for the golfer's tendency to deviate the putter face from the perpendicular orientation with respect to the line-of-putt. The steps of the method include addressing standing on an opposing side of a golf hole from the golf ball resting a surface of the green, straddling an extending line of the putt extending from the golf ball through the golf hole, extending a golf putter from the opposing side of the golf hole and positioning the putter head of the golf putter behind the golf ball with respect to the golf hole, resting the putter head of the golf putter on the surface of the green behind the ball and drawing the putter head of the golf putter toward the golf hole thereby striking the golf ball on a side of the golf ball opposing the golf hole such that the golf ball travels towards the hole.

14 Claims, 5 Drawing Sheets

GOLF CLUB PUTTER AND METHOD OF PUTTING

TECHNICAL FIELD OF THE INVENTION

The present invention relates to a golf putter and a method of putting. More particularly, the putter according to the present invention is specifically designed for use with a modified putting style wherein the golfer reaches across the hole and uses the putter in a pulling motion in directing the ball towards the hole. The putting method according to the present invention complies with current rules of golf as promulgated by the Royal and Ancient Golf Association as well as the United States Golf Association

BACKGROUND OF THE INVENTION

In an effort to improve the putting performance of golfers, prior golf club putters have been provided with a variety of head and shaft constructions and arrangements. In that the putt is perhaps the single most difficult yet important shot in golf, the selection of these components which match the golfer both physically and mentally is important. Approximately one half of the allotted strokes on any given golf course in order to achieve an even par round are putts.

Before a player can even stroke the ball on a putting surface of a green, the player must visually examine the contour of the putting surface and judge its effect on the path of the ball rolling toward the hole from the current position of the ball. Other characteristics of the putting surface or other factors can also have a significant effect on the path of a put already stroked and rolling towards the hole. In this regard, given the various putting strokes utilized by individuals, it is necessary to design a putter construction which can not only be utilized by various players having various putting strokes, but also by a single player who may have a varying putting stroke depending upon the length of the putt.

As noted above, golf courses are designed and standards for scoring are set based on the assumption that a player will be able to hit the ball onto the putting surface in two strokes less than par for each hole. Once the ball is on the putting surface, the player is allowed two putts to stroke the ball into the hole in order to play the hole at even par. Thus, an 18-hole course is designed to allow 36 putts in a round of golf played at even par. Accordingly, a premium is placed on making a second putt when a first putt of a longer distance not falling in the hole, settles relatively close to the hole and within a distance of less than two feet. Many a golf tournaments are won and lost by the players ability to make short and what may appear to be relatively simple putts. However, as one of the most recent major golf tournaments will attest, making putts of this distance is not a guarantee.

As noted hereinabove, in an effort to improve the putting performance of golfers, prior golf club putters have been provided with a variety of head and shaft constructions and arrangements. One such putter has an elongated cylindrical head with a conventional straight shaft attached to the head and in alignment with the longitudinal axis of the head. Further, putters such as those similar to that illustrated in U.S. Pat. No. 4,508,342 include an elongated head and a shaft having a shank and an offset portion adjacent its lower end which is connected to the elongated head at a point immediately adjacent the center of the head between the proposed ends thereof. In accordance with that disclosed in such patent, the point at which the offset portion of the shaft is connected to the head is also offset transversely from the longitudinal axis of the head so that it lies between this axis and the back of the head. This is presumed to provide the player with a better view of the ball and putter head when putting. However, it is not possible to utilize this putter in carrying out the putting stroke in accordance with the present invention as will be discussed in greater detail hereinbelow.

Numerous putter designs similar to that discussed hereinabove have been developed over the years. Many of these putters having various materials from which the putter head is made. These materials may add to or take away from the overall weight of the putter in order to provide a better feel to the user. Various materials are illustrated, for example, in U.S. Pat. No. 5,447,310, where the head includes a rounded striking surface wherein the heal and toe portions are of a greater weight than the central portion. Additionally, putter heads may take on a variety of configurations which reduce the frictional component of the putter or improve the balance and feel of the putter with respect to the user.

A noted contemporary instructor on putting, Dave Pells, has studied the effects of misalignment relative to a target line due to the putters swing path, the putter face and the optimum hitting location on the putter surface each of which effect the ultimate putting success. As noted in U.S. Pat. No. 6,152,832, Mr. Pell's has found that all three types of misalignment caused significant error in the putting stroke and thus decrease the chance of the ball going into the hole. However, it is clear that misalignment of the putter face with respect to a line-of-putt causes the largest deviation from the players intended path of any particular putt. In order to reduce the possibility of misalignment of the putter face, path and hitting location, Mr. Pells' recommends that the players' putting stroke start with the optimum hitting location on the putting face immediately adjacent the ball and that the stroke travel along a path aligned with the target line with the face remaining perpendicular to the target line for the entire stroke. However, when a player swings the putter around the spine only, such a stroke often times does not result. In effect, the putter path corresponds to the target line at only one point at its arc and the face is perpendicular to the target line at only one point in its arc and those two points do not necessarily coincide. Thus, to execute a stroke in a path along a target line and with a square putter face while using a traditional putting stance and stroke requires a complex combination of multi-access rotational movements. Executing such a multi-access stroke in a manner that accomplishes the primary and complex task of causing the ball to roll smoothly along a precise path at a precise speed renders the most difficult and important stroke even more difficult.

Some of the most common practice aids and drills in golf are designed purely to enable players to engrain this complex, cumbersome multi-axis putting stroke into their muscle memory. Other players simply concentrate on swinging the putter around only their spine and training themselves to hit the ball at the precise moment in time when the putter path, face and hitting location are correctly aligned with the target line. Thus, both wildly adopted approaches to executing the traditional putter stroke suffer from disadvantages that interfere with the ultimate goal, putting the ball into the hole.

As will become clear from the following detailed description, the present invention is directed to a putter and a method of putting very short putts, i.e., within one to two feet of the hole. During such short puts, the alignment of the putter face perpendicular to the putting line is critical in that a very small degree of deviation from this perpendicular will result on the putt either falling to the left or right of the hole rather than being directly on line. With putts of ten feet or more, such alignment while critical is not the sole essence of the putt in that speed and the surface of the green will aid in directing the ball towards the hole. Moreover, a golfer who performs a putting stroke on a twenty or more foot putt with the ball coming to rest within a few inches of the hole would be quite satisfied with the putt; however, a golfer having a one to two foot putt which passes the hole only ¼" outside the rim of the hole clearly would not be satisfied. Accordingly, it is imperative on such putts that the putting face remain perpendicularly oriented with respect to the line of the putt in that speed and the terrain of the putting surface is less important at such distances. Accordingly, if a golfer is less apt to miss what can be determined as a short putt, the golfer's ability to finish the hole within the requisite number of putts will be greatly enhanced.

SUMMARY OF THE INVENTION

The objects, features and advantages of the present invention are to provide a golf club putter and method of putting which complies with the rules of golf as promulgated by the Royal and Ancient Golf Association as well as the United States Golf Association and which provides the player with an improved view of the ball and head of the putter when putting putts of a short distance and an improved balance and feel of the club during such putts. Additionally, the method of putting in accordance with the present invention provides a putting stroke which aids the golfer in carrying out a putting stroke which maintains the putting face of the putter in a perpendicular orientation which respect to the line-of-putt. That is, the method set forth in accordance with the present invention compensates for an inaccurate swing so that when the putter head strikes the ball it is at a right angle with respect to the desired path of travel of the ball thereby compensating for the golfer's tendency to deviate the putter face from the perpendicular orientation with respect to the line-of-putt.

In accordance with the present invention, a method of putting a golf ball in a green of a golf course by a golfer is set forth and includes the steps of standing on an opposing side of a golf hole from the golf ball resting a surface of the green, addressing an extending line of the putt extending from the golf ball through the golf hole, extending a golf putter from the opposing side of the golf hole and positioning the putter head of the golf putter behind the golf ball with respect to the golf hole, resting the putter head of the golf putter on the surface of the green behind the ball and drawing the putter head of the golf putter toward the golf hole thereby striking the golf ball on a side of the golf ball opposing the golf hole such that the golf ball travels towards the hole. When addressing the extended line-of-putt, the golfer positions their feet on opposing sides of the extended line of the putt and preferably the feet of the golfer are spaced in equal distance from the extended line of the putt. The method may also be carried out with on foot on the extended line of the putt or both feet on the same side of the extended line of the putt; however, greater accuracy is achieved when straddling the extended line of the putt.

When resting the putter head on the surface of the green behind the ball, the golfer positions the length of the putter head substantially perpendicular to the extended line-of-putt such that the drawing of the putter head toward the golf ball includes sliding the putter head on the surface of the green which removes one of the components of maintaining the putter head perpendicular to the line-of-putt less variable. Additionally, when extending the golf putter from the opposing side of the golf hole, the golfer can align at least a portion a shaft of the golf putter along the extended line-of-putt thereby enhancing the alignment of the putter head.

Such a method can be carried out utilizing a putter including a putter head where a length of the putter head is greater than the width of the putter head, a flange secured to and extending along a length of the putter head, a shaft extending from the flange and having a first end secured to the flange and a grip secured to a second end of the shaft. Such that at least a portion of the shaft extends substantially transversely to the flange and is aligned with a central portion of the putter head. The putter head is preferably substantially cylindrical having a length which is greater than its diameter with the flange being of a thickness less than a diameter of the putter head. Further, the flange is preferably of a length substantially equal to that of the putter head and may take on a triangular configuration. With such triangular configuration, the shaft would preferably extend from an apex of the triangle and consequently be centered with respect to a putting surface of the putter head.

These as well as additional advantages of the present invention will become apparent of the following detailed description of the present invention when read in light of the several figures.

DETAILED DESCRIPTION OF THE INVENTION

Figure 1:
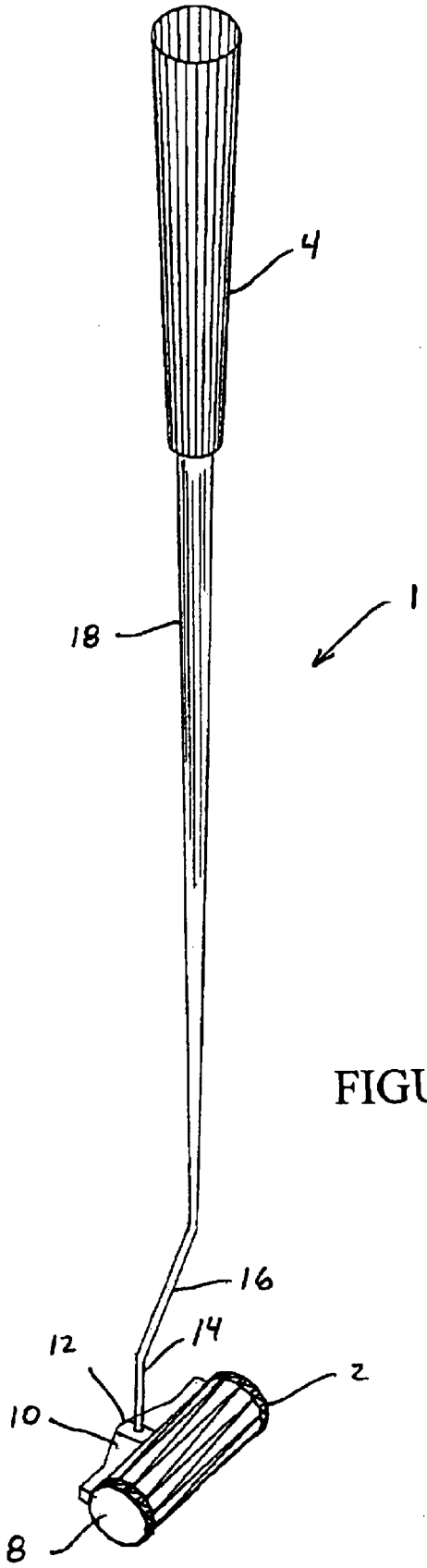
FIG. 1 is a perspective view of a putter for use in carrying out the method of putting in accordance with the present invention.

FIG. 1 illustrates an exemplary embodiment of the present invention and more particularly a golf putter incorporating the present invention and for carrying out a method of putting in accordance with the present invention. The golf putter 1 includes a putter head 2, to a grip or handle 4 and an elongated shaft 6 extending therebetween. As will be readily apparent, the grip may take on any known configuration and the shaft may take on a variety of configurations which are all well within the scope of the present invention. The putter head 2 preferably includes an elongated cylinder 8 having a suitable dimension for contacting and directing a ball toward a hole. The details of the particular method set forth in accordance with the present invention will be described in greater detail hereinbelow.

By way of example, the cylindrical body 8 may be of a diameter of ½" and a length of approximately 4½". Such dimensions while generally within the range of putters typically available from most pro shops may be varied depending upon the preference of the user. Secured to the cylindrical body 8 is a flange 10 which extends along substantially the entire length of the cylindrical body 8. The flange 10 may be slightly longer or slightly shorter than the cylindrical body 8 while achieving the advantages set forth in accordance with the present invention and remaining within the spirit and scope of the present invention. As noted hereinabove, connected to the flange 10 is the shaft 6 which extends upwardly from a central portion 12 of the flange 10. The particular configuration of the flange 10 may be of any geometry; however, an exemplary or preferred embodiment will be described in greater detail hereinbelow.

With reference to FIG. 1, the shaft includes an upwardly extending portion 14, an angular portion 16 and a remaining portion 18 which receives the grip 4 at a distal end thereof. The remaining portion 18 may be of any desired length so long as it complies with the rules of golf as promulgated by the United States Golf Association. With respect to the upwardly extending portion 14 and angular portion 16, the characteristics of these portions are dictated by the rules of golf and particularly Appendix II, Design of Clubs, (2)(a–c). That is, the shaft shall be straight from the top of the grip to a point not more than 5" above the sole, measured from the point where the shaft ceases to be straight along the axis along the bent part of the shaft and the neck and/or socket. Accordingly, the length of the upwardly extending portion 14 and angular portion 16 combined may not be more than 5" from the sole of the putter head 2. Various configurations of this portion of the shaft will likewise be described in greater detail hereinbelow.

Figure 2:
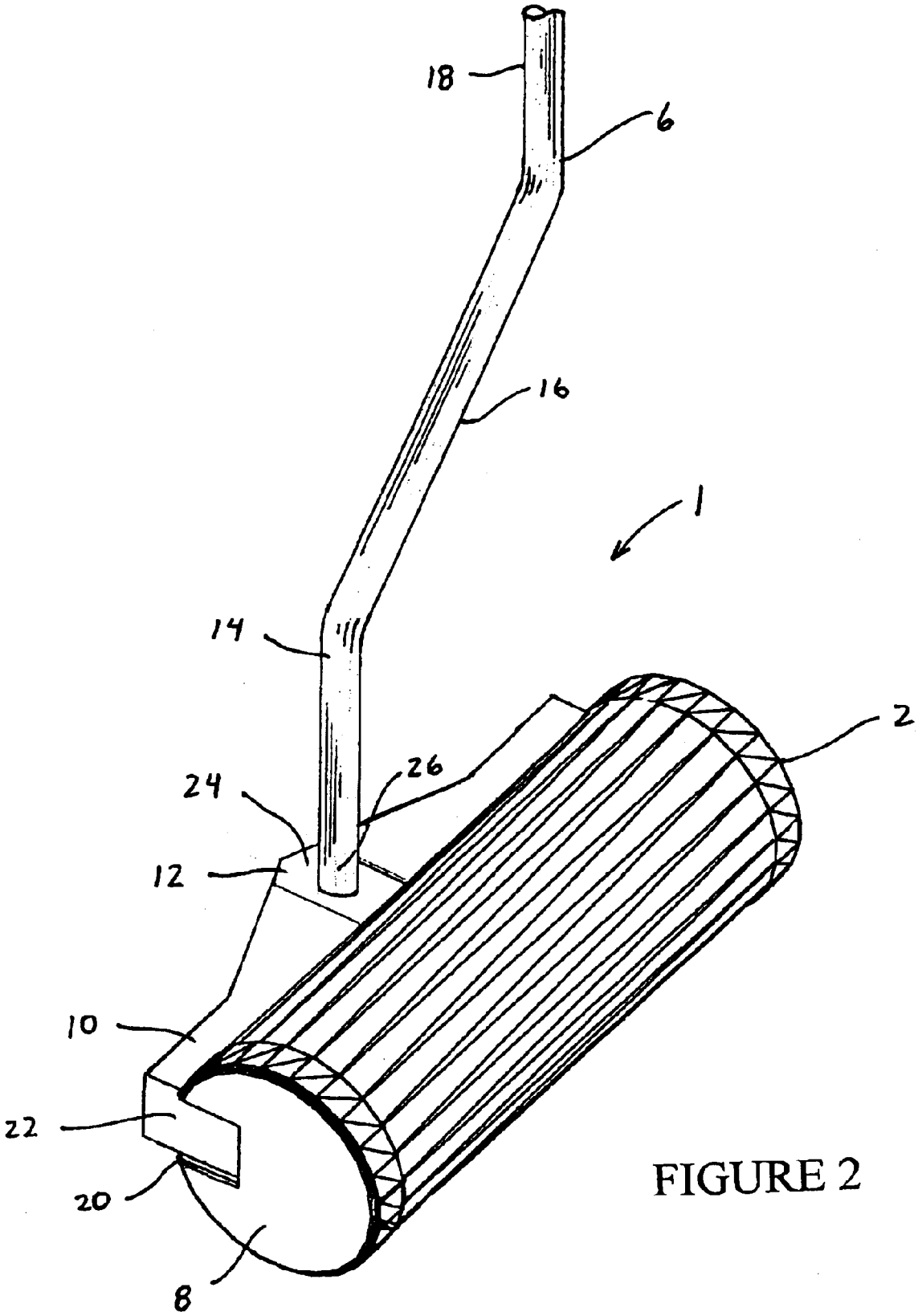
FIG. 2 is an enlarged prospective view of the putter head in accordance with the present invention.

With reference to FIG. 2, the putter head 2 is illustrated in expanded form and illustrates the flange 10 as being partially inserted into a groove 20 formed in the cylindrical body 8. This groove extends along the entire length of the cylindrical body and receives a base portion 22 of the flange 10. The central portion 12 of the flange takes on a triangular configuration with the shaft extending from a region adjacent in apex 24 of the flange 10. In doing so, the proximal portion 26 of the upwardly extending portion 14 of the shaft 6 is positioned directly behind what can be determined as a sweet spot or central contact area of the putter head 2. This provides for greater stability in not only conventional putting but carrying out the putting method set forth hereinbelow in a stable manner. Once again, the putter head 2 is illustrated as being a substantially cylindrical element having a flange secured thereto; however, the putter head 2 may take on a variety of configurations such as oval, multi-angular or elongated so long as the putting method described hereinbelow is carried out in a stable manner. As can be appreciated from FIG. 2, the connection of the shaft 6 with the flange 10 positions the shaft at a point with respect to the cylindrical body 8 which is offset from a central axis of the cylindrical body 8. In doing so, the method described in detail hereinbelow can be reliably carried out without obstruction from the shaft.

Referring now to FIGS. 3–6, various embodiments of the present invention will now be described in detail hereinbelow.

With respect to FIG. 3, this figure illustrates essentially the embodiment set forth in FIGS. 1 and 2 wherein the putter head 2 is comprised of the cylindrical body 8 and flange 10 described in detail hereinabove. The shaft 6 includes an upwardly extending portion 14, an angular portion 16 and a remaining portion 18. The upwardly extending portion 14 is connected to the flange 10 adjacent the apex 24 of the triangularly configured flange 10. The particular positioning of the connection of the upwardly extending portion 14 of the shaft is best illustrated in FIG. 4. Further, it can be readily appreciated by those skilled in the art that the upwardly extending portion 14 of the shaft may be connected to the flange 10 in any known manner so as to position the shaft 14 behind a sweet spot of the cylindrical body 8. Further, the connection between the upwardly extending portion 14 of the shaft 6 and the flange 10 may be offset from the sweet spot of the cylindrical body 8 depending upon the particular preference of the user. However, the configuration illustrated herein provides for a higher degree of stability in carrying out the putting method described hereinbelow.

Figure 5:
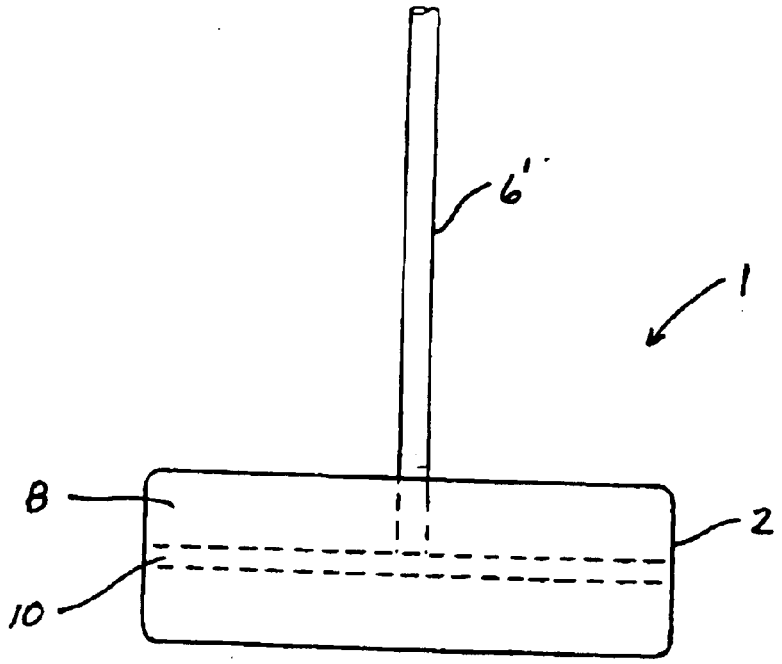
FIG. 5 is an alternative embodiment of the shaft arrangement of the putter head in accordance wit the present invention.

Referring to FIG. 5, it can be appreciated that the putter head 2 and more particularly the cylindrical body 8 and flange 10 may incorporate a shaft 6 which extends straight upwardly from the flange 10. That is, the shaft 6 would not include an angular portion 16. While the rules of golf and particularly Appendix II, (1)(d), Alignment, requires that the projection of the straight part of the shaft onto the vertical plane through the toe and heal shall diverge from the vertical by at least 10°, this dictates clubs the standards for putters which are to be used in tournament play and a player is free to use any club configuration in recreational play and particularly may use a putter of any known configuration for practice or for aiding a player in practicing the alignment of putts. In this regard, when using the putter head 2 illustrated in FIG. 5, the method set forth hereinbelow can be readily carried out with an added extended alignment benefit; however, as will be discussed in greater detail hereinbelow, the particular method set forth hereinbelow may be readily carried out utilizing a putter which conforms to all U.S.G.A. specifications.

Figure 3:
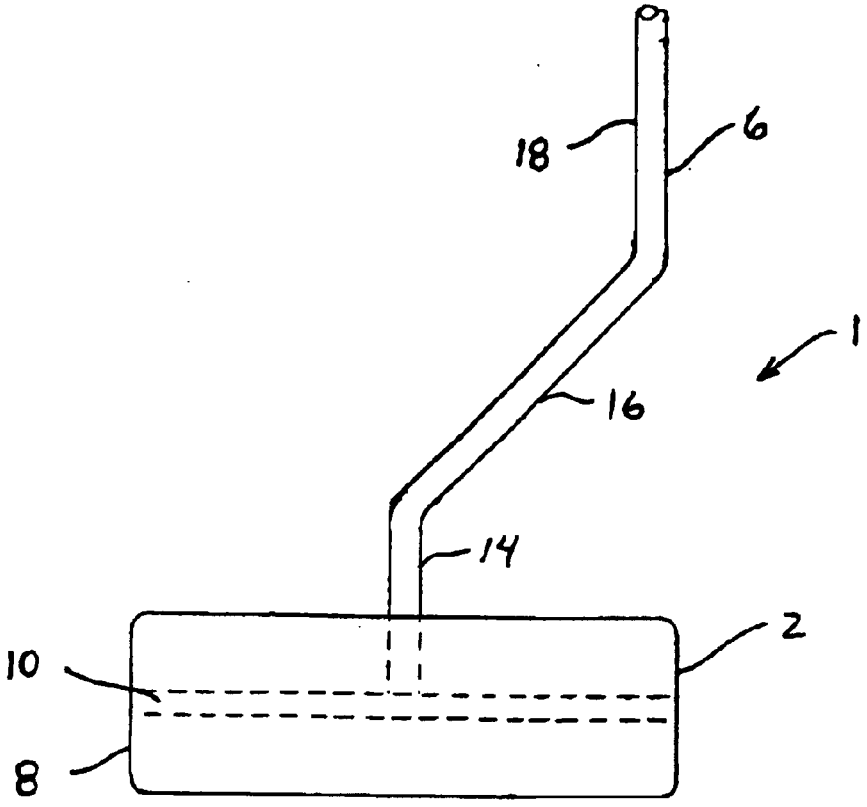
FIG. 3 is an elevation view of the putter head of FIG. 2
Figure 4:
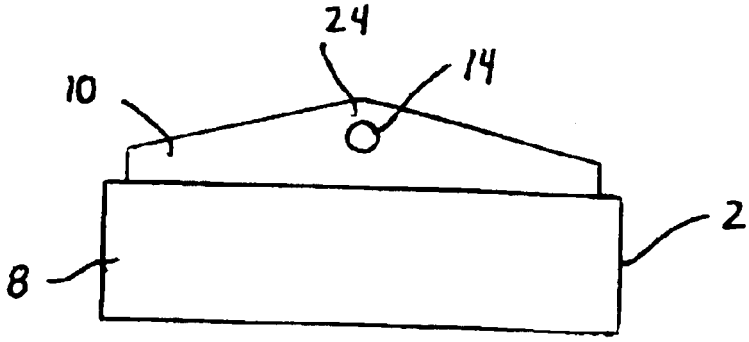
FIG. 4 is a planed view of the putter head of FIG. 2.
Figure 6:
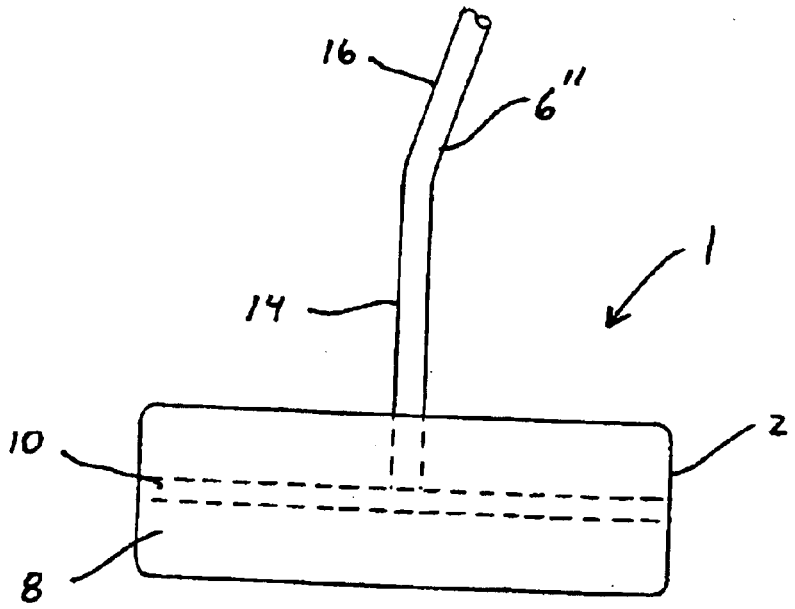
FIG. 6 is an alternative embodiment of the shaft configuration of the putter head in accordance wit the present invention.

Referring now to FIG. 6, a putter head 2 similar to that set forth in each of FIGS. 3 and 5 is illustrated and similarly includes the cylindrical body 8 and flange 10. Connected to the flange 10 in the manner similar to that of FIGS. 1–5, is the shaft 6 which includes an upstanding portion 14 and an angular portion 16. In this embodiment, the angular portion 16 would extend upwardly to a grip 4 thereby not including a remaining portion 18. As noted hereinabove, the upwardly extending portion 14 may extend upwardly a maximum of 5" from a sole of the putter before angling along the angular portion 16 at an angle of at least 10° with respect to the upwardly extending portion 14. Additionally, while not specifically illustrated the shaft may include only an angular portion 16 extending directly from the flange 10 at an angle of not less than 10° thereby removing the need for an upwardly extending portion 14 or a remaining portion 18. While the angles of the angular portion 16 is referred to as being at least being 10°, this reference is merely made in accordance with the rules governing the design of clubs as promulgated by the U.S.G.A. As one of ordinary skill in the art can readily appreciate, the particular angle of the shaft with respect to the putter head may vary and is strictly a function of the comfort of the user.

With these particular features in mind, the method of putting set forth in accordance with the present invention will now be described in greater detail with reference to FIGS. 7 and 8. Particularly, FIGS. 7 and 8 illustrate, schematically, the method of putting set forth in accordance with the present invention.

Figure 7:
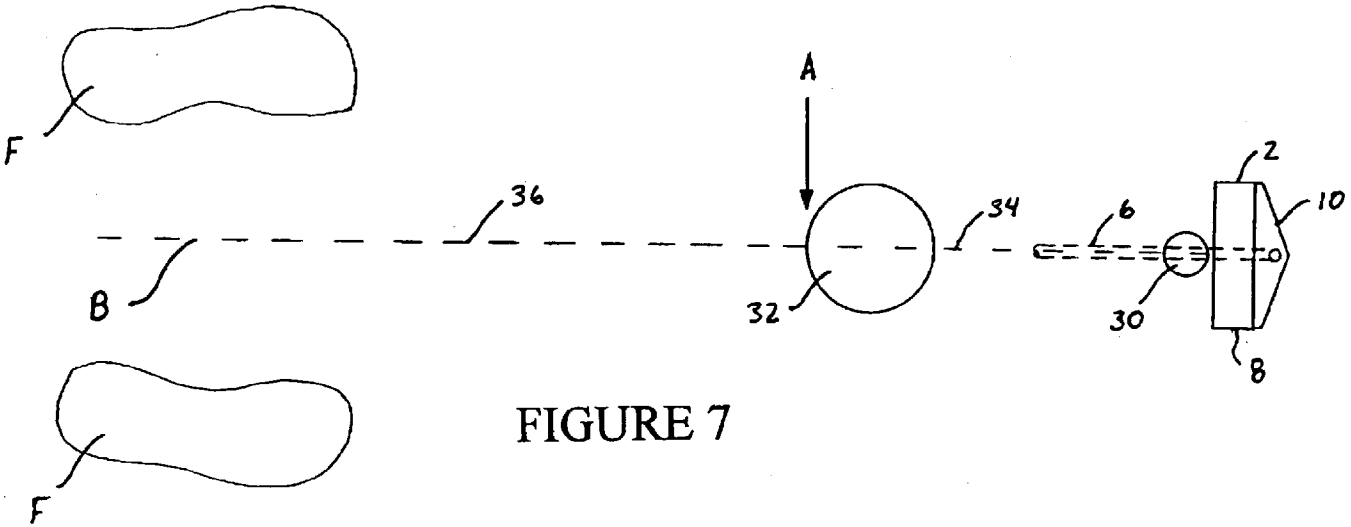
FIG. 7 is a plan schematic illustration of the method carried out in accordance with the present invention.

With reference to FIG. 7, it is noted that the method of putting includes positioning the putter head 2 adjacent a golf ball 30 which is desired to be putted into a golf hole 32. As described in detail in the Rules of Golf and particularly Rule 16, the Putting Green, the definition of a line-of-putt is a line which the player wishes his ball to take after a stroke on the putting green. Except with respect to Rule 16-1e, the line-of-putt includes a reasonable distance on either side of the intended line and the line-of-putt does not extend beyond the hole. Accordingly, the line-of-putt extends from the ball 30 to a point A at the far side of the hole 32. In accordance with the present invention, an extended line-of-putt 36 extends from the ball along the line-of-putt 34 which is the line on which the player wishes the ball to take after a stroke on the putting green and passed a golfer who is positioned at position B along the extended line-of-putt 36. Rule 16-1e recites that the player shall not take a stroke on the putting green from a stance astride, or with either foot touching, the line-of-putt or an extension of that line behind the ball; however, the Rules of Golf make clear that the line-of-putt ends at point A at the back side of the hole and does extend beyond the hole to the point B referenced in FIGS. 7 and 8. Accordingly, it is within the Rules of Golf that a golfer may astride, stand on, beside or straddle the extended line-of-putt 36 referred to FIG. 7. In carrying out the method of putting in accordance with the present invention, the golfer may astride the extended line-of-putt 36 positioning their feet F on either side of the extended line-of-putt 36 and more specifically position each foot an equal distance from the extended line-of-putt 36 and thus standing on an opposing side of the golf hole 32 from the golf ball 30 resting on a surface 38 of the green. The golfer then extends the golf putter and particularly positions the putter head 2 of the golf putter behind the ball with respect to the golf hole and rests the putter heads on the surface 38 of the green. By utilizing the surface 38 of the green, angular orientation of the sole of the putter with respect to the green is prevented thus removing one of the variables required to be controlled by the golfer during performance of a putt. Once in this position, the golfer may align the shaft 6 of the golf putter along the line-of-putt 34. As noted hereinabove, the shaft 6 takes on a number of configurations and consequently in order to most benefit the putting method described herein, a shaft configuration similar to that set forth in any of FIGS. 3, 5 and 6 would be beneficial. Additionally, when utilizing the configurations set forth in FIGS. 3 and 6, the longer the upwardly extending portion 14, the better tendency toward alignment will be achieved. Accordingly, as can be readily appreciated, it is desired to maximize the length of the straight portion extending from the flange 10 of the putter head 2. Once in this position, the putter head 2 of the golf putter is drawn toward the golf hole 32 by the golfer, striking the golf ball 30 at a side of the golf ball 30 opposing the golf hole 32 such that the golf ball 30 travels toward the golf hole. As can be readily appreciated, the drawing motion particularly a drawing motion utilizing alignment of the putter shaft with respect to the line-of-putt removes or substantially minimizes yet another variable and the most significant variable in carrying out putts of a length of two feet or less with respect to the hole. That is, most short putts are very dependent upon the angular orientation of the contact surface of the golf putter with respect to the desired line-of-putt. As can be readily appreciated, utilizing the drawing motion as well as the stable surface of the green, the golfer can readily maintain the contact face of the golf putter perpendicular to the line-of-putt. Depending upon the length of the short putt, a deviation from the perpendicular orientation of the contact surface with respect to the line-of-putt can result in the ball traveling two or more inches to either the right or left of the center of the hole. Consequently, it is clear that maintaining the perpendicular orientation of the contact surface of the putter head with respect to the line-of-putt is critical in ensuring that the golf ball 30 travels along the line-of-putt toward the golf hole 32 with minimal deviation from the line-of-putt.

Figure 8:
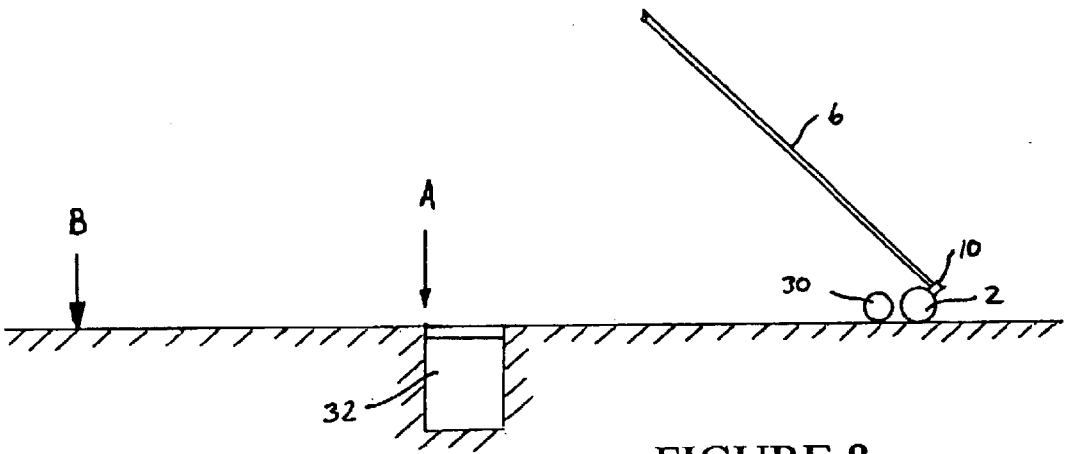
FIG. 8 is a side schematic illustration of the method carried out in accordance with the present invention.

Additionally, as can be appreciated from FIG. 8 because the putter head 2 includes flange 10 and the shaft 6 of the golf putter is secured to a position on the flange 10 spaced from a central axis of the cylindrical body 8, the shaft is positioned away from the golf ball 30 in order to minimize the possibility of any contact between the shaft 6 and ball 30. Further, as best illustrated in FIG. 7, the shaft 6 can be readily positioned to extend down the line-of-putt 34 which, as noted hereinabove, aids in the positioning the contact surface of the cylindrical body 8 in a position transverse to the line-of-putt 34. As is readily apparent, carrying out the method of putting in accordance with the present invention and particularly carrying out such method utilizing the golf putter described hereinabove, maximizes the golfer's chance of making a short putt by minimizing variables which result in misalignment of the contact surface of the putter head with the line-of-putt 34.

These as well as additional advantages of the present invention will become readily apparent to one of ordinary skill in the art without deviating from the spirit and scope thereof. Accordingly, the spirit and scope of the present invention is to be limited only by appended claims.

What is claimed:

1. A golf putter for putting a golf ball on a green of a golf course by a golfer comprising:

an elongated putter head comprising a cylindrical body having a ball striking surface, a length of said putter head being greater than a width of said putter head with said cylindrical body extending around and parallel to a longitudinal axis of said putter head, said ball striking surface defined by a portion of said cylindrical body and continuing from at least a lower surface of said putter head to an upper surface of said puffer head;

a flange secured to and extending along a length of said putter head; said flange spaced from the upper and lower surfaces of said putter head and located substantially in a plane that is generally parallel to a horizontal puffing surface when said lower surface of said putter head is in contact with the putting surface;

a shaft having a first end secured to said flange and extending generally transversely upwardly from said flange and located rearwardly of said cylindrical body when said flange is parallel to a horizontal putting surface; and a grip secured to a second end of said shaft.

2. The golf putter as defined in claim 1, wherein at least a first portion of said shaft extends substantially transversely to said flange.

3. The golf putter as defined in claim 2, wherein a portion of said shaft including said grip extends at an angle with respect to said first portion of said shaft.

4. The golf putter as defined in claim 2, wherein a second portion of said shaft extends at an angle with respect to said first portion of said shaft.

5. The golf putter as defined in claim 4, wherein a third portion of said shaft extends at an angle with respect to said second portion of said shaft.

6. The golf putter as defined in claim 5, wherein said third portion of said shaft extends substantially parallel to said first portion of said shaft.

7. The golf putter as defined in claim 6, wherein said grip is secured to said third portion of said shaft.

8. The golf putter as defined in claim 1, wherein an entire length of said shaft extends substantially transversely to said flange.

9. The golf putter as defined in claim 1, wherein a length of said flange is substantially equal to said length of said putter head.

10. The golf putter as defined in claim 1, wherein a length of said flange is longer than said putter head.

11. The golf putter as defined in claim 1, wherein a thickness of said flange is less than the diameter of said putter head.

12. The golf putter as defined in claim 1, wherein said flange includes a base portion secured to said putter head and a distal portion for receiving said shaft.

13. The golf putter as defined in claim 1, wherein said flange is of a triangular configuration and a base of said triangular configuration is in contact with said putter head.

14. The golf putter as defined in claim 13, wherein the shaft extends from an apex of said triangular configuration of said flange.

* * * * *